US008632165B2

(12) United States Patent
Akahane et al.

(10) Patent No.: US 8,632,165 B2
(45) **Date of Patent: *Jan. 21, 2014**

(54) LIQUID-EJECTING HEAD AND LIQUID-EJECTING APPARATUS

(75) Inventors: Fujio Akahane, Azumino (JP); Tomoaki Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 72 days.

This patent is subject to a terminal disclaimer.

(21) Appl. No.: 13/350,539

(22) Filed: Jan. 13, 2012

(65) Prior Publication Data

US 2012/0182354 A1 Jul. 19, 2012

(30) Foreign Application Priority Data

Jan. 13, 2011 (JP) ..... 2011-004596

(51) Int. Cl.
*B41J 2/04* (2006.01)

(52) U.S. Cl.
USPC ..... 347/54

(58) Field of Classification Search
USPC ..... 347/89
See application file for complete search history.

(56) References Cited

U.S. PATENT DOCUMENTS

| | | | | |
|---|---|---|---|---|
| 5,087,931 | A | 2/1992 | Rawson | |
| 5,748,214 | A | 5/1998 | Usui et al. | |
| 6,022,100 | A | 2/2000 | Takenouchi et al. | |
| 7,344,229 | B2 | 3/2008 | Ito et al. | |
| 7,806,515 | B2 | 10/2010 | Harvey et al. | |
| 2012/0176450 | A1 * | 7/2012 | Akahane et al. | 347/47 |

FOREIGN PATENT DOCUMENTS

| | | | |
|---|---|---|---|
| JP | 3161095 | B2 | 2/2001 |
| JP | 2009-143168 | A | 7/2009 |
| JP | 2009-247938 | A | 10/2009 |
| JP | 2010-082900 | A | 4/2010 |

* cited by examiner

*Primary Examiner* — Lisa M Solomon
(74) *Attorney, Agent, or Firm* — Kilpatrick Townsend & Stockton LLP

(57) ABSTRACT

A liquid-ejecting head includes a channel which is in communication with a nozzle opening and which includes a pressure-generating chamber, a circulation channel that serves to circulate a liquid in the channel, and a pressure generator that serves to generate pressure change. The circulation channel has a narrow portion including a first wall and a second wall, the first wall tilting with respect to a forward direction of a liquid flows and serving to gradually decrease the cross-sectional area, the second wall tilting with respect to the flow direction and serving to gradually increase the cross-sectional area. The tilt angle of the first wall with respect to the inner surface of the circulation channel is larger than the tilt angle of the second wall with respect to the inner surface of the circulation channel at the downstream side.

10 Claims, 10 Drawing Sheets

LIQUID-EJECTING HEAD AND LIQUID-EJECTING APPARATUS

This application claims a priority to Japanese Patent Application No. 2011-004596 filed on Jan. 13, 2011 which is hereby expressly incorporated by reference herein in its entirety.

BACKGROUND

1. Technical Field

The present invention relates to a liquid-ejecting head and liquid-ejecting apparatus in which liquid is ejected from a nozzle opening, especially relates to an ink jet recording head and ink jet recording apparatus in which ink is ejected as the liquid.

2. Related Art

An ink jet recording head is one of typical examples of a liquid-ejecting head from which a droplet is ejected. Examples of the ink jet recording head include a recording head which includes a channel-forming substrate having a pressure-generating chamber and a piezoelectric actuator provided on one surface of the channel-forming substrate. In such a recording head, the piezoelectric actuator is deformed to apply pressure to the inside of the pressure-generating chamber, thereby ejecting an ink droplet from a nozzle opening.

In such an ink jet recording head, components contained in an ink evaporate from the nozzle opening, thereby increasing the viscosity of the ink. Variation is therefore caused in ink droplet ejection characteristics with the passage of time, and the quality of liquid ejection cannot be accordingly uniformly maintained. In addition, components contained in ink precipitate with the result that difference is generated between components contained in a continuously ejected ink droplet and components contained in an intermittently ejected ink droplet. Variation is therefore also caused in quality of liquid ejection.

An ink jet recording head is therefore proposed (for example, JP-A-2009-247938 and Japanese Patent No. 3161095), in which a plurality of pressure-generating chambers are in communication with a common liquid chamber in common, ink is supplied to the common liquid chamber and is subsequently retrieved from the common liquid chamber, and the supplying and retrieving are repeated with the result that the ink is circulated, thereby suppressing the increase of ink viscosity and precipitation of components contained in the ink.

In order to circulate ink in a common liquid chamber which is in communication with each of the pressure-generating chambers as in the case of JP-A-2009-247938 and Japanese Patent No. 3161095, however, a pressure generator such as a pump needs to be provided. The size of the recording head is therefore problematically increased, and production costs are also disadvantageously increased.

Such disadvantages arise not only in the ink jet recording head from which ink is ejected but in a liquid-ejecting head from which liquids other than the ink are ejected.

SUMMARY

An advantage of some aspects of the invention is that it provides a liquid-ejecting head and liquid-ejecting apparatus, which can serve to suppress the increase of liquid viscosity and the precipitation of components contained in the liquid with the result that the quality of liquid ejection can be enhanced and which can be each provided so as to have a small size with the result that the production costs can be reduced.

According to a first aspect of the invention, there is provided a liquid-ejecting head including: a channel that is in communication with a nozzle opening that serves for liquid ejection, the channel including a pressure-generating chamber; a circulation channel that serves to circulate a liquid in the channel; and a pressure generator that serves to generate pressure change in a liquid in the pressure-generating chamber. The circulation channel has a narrow portion including a first wall and a second wall, the first wall tilting with respect to a forward direction in which a liquid flows and serving to gradually decrease the cross-sectional area of the circulation channel toward the downstream side in the forward direction, the second wall tilting with respect to the flow direction and serving to gradually increase the cross-sectional area that has been gradually decreased by the first wall. The tilt angle of the first wall with respect to the inner surface of the circulation channel at the upstream side relative to the first wall is larger than the tilt angle of the second wall with respect to the inner surface of the circulation channel at the downstream side relative to the second wall.

In such a liquid-ejecting head, formation of the narrow portion enables a difference in channel resistance to be generated between the forward direction in which a liquid flows in the circulation channel and a direction opposite thereto. A liquid can be therefore circulated only as a result of generating pressure change in the liquid in the channel by the pressure generator, and use of an additional unit such as a pump is accordingly excluded, thereby being able to reduce the size of the liquid-ejecting head and production costs.

It is preferable that a plurality of the narrow portions are provided. By virtue of such a configuration, a difference (ratio) in the channel resistance between the forward direction and the direction opposite thereto can be increased.

It is preferable that the first wall has a curved surface.

It is preferable that the channel includes a common liquid chamber that is in communication with a plurality of the pressure-generating chambers in common. In addition, it is preferable that the circulation channel has the two ends that are in communication with the common liquid chamber. By virtue of such a configuration, liquid in the common liquid chamber can be circulated.

It is preferable that the channel includes a common liquid chamber that is in communication with a plurality of the pressure-generating chambers in common. In addition, it is preferable that the circulation channel has one end that is in communication with the common liquid chamber and has the other end that is in communication with each of the pressure-generating chambers. By virtue of such a configuration, a liquid in the vicinity of the nozzle opening can be circulated. Furthermore, drying of a liquid immediately before being ejected can be steadily suppressed, and the precipitation of components contained in the liquid can be also steadily suppressed.

According to a second aspect of the invention, there is provided a liquid-ejecting apparatus including the liquid-ejecting head having any of the above advantages.

In such a liquid-ejecting apparatus, the quality of liquid ejection can be enhanced, and the size of the apparatus can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be hereinafter described in detail.

First Embodiment

Figure 1:
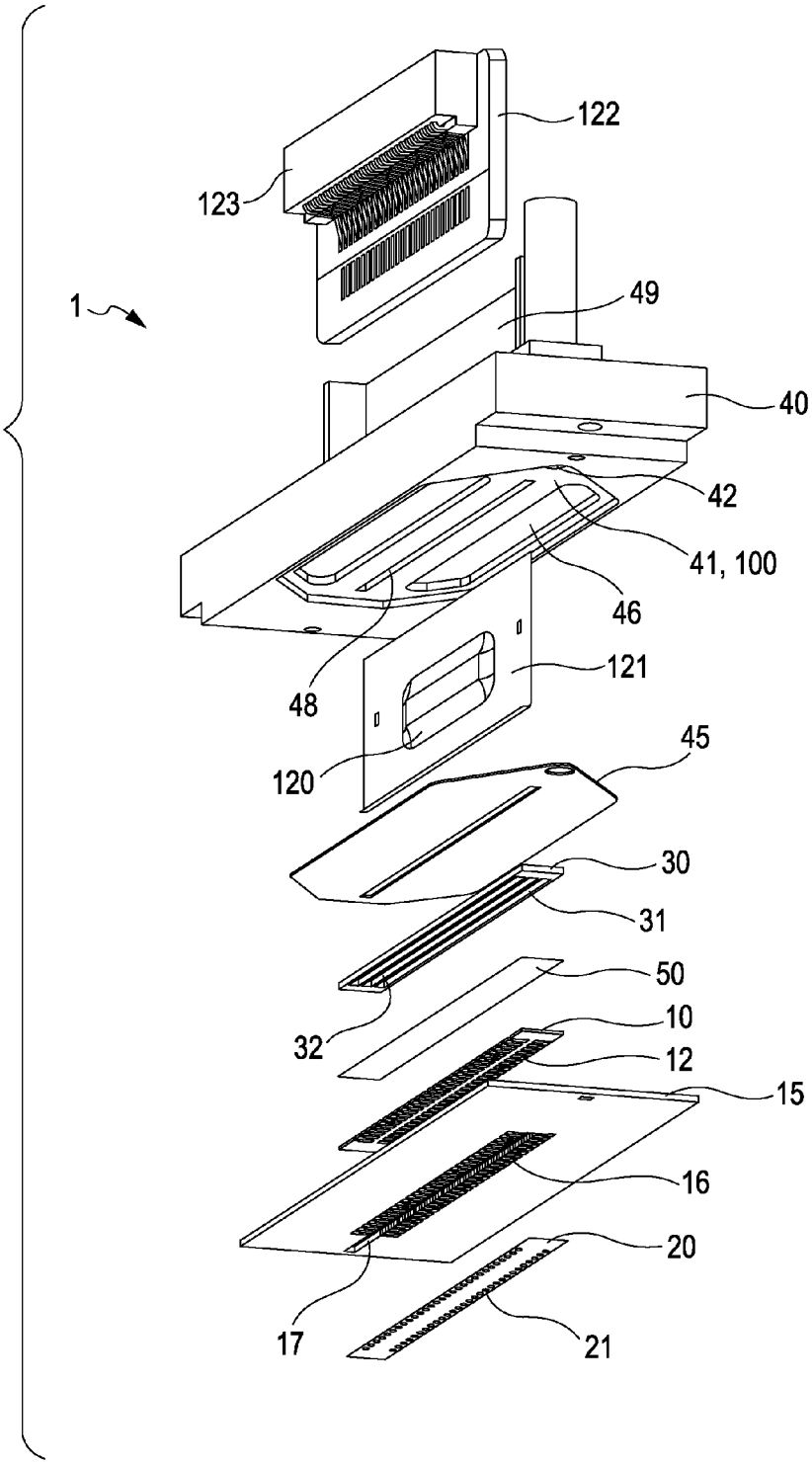
FIG. 1 is an exploded perspective view illustrating a recording head of a first embodiment.
Figure 2:
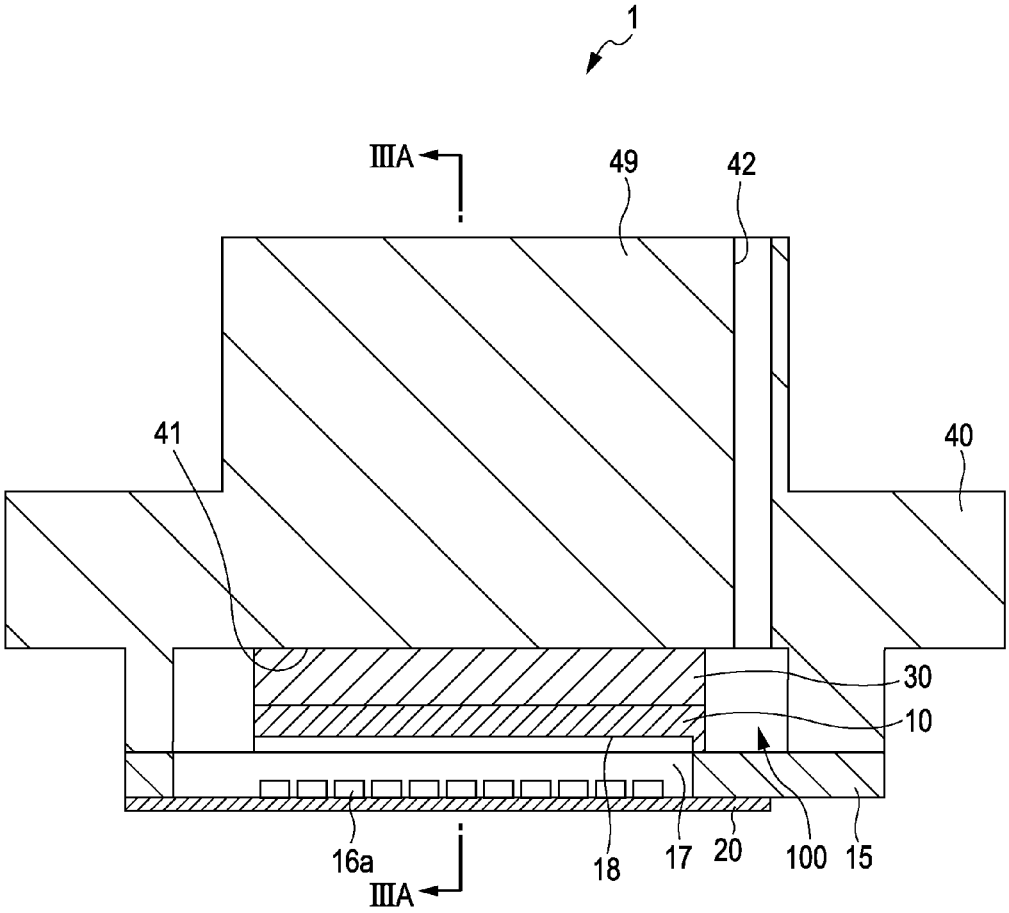
FIG. 2 is a cross-sectional view illustrating the recording head of the first embodiment.
Figure 3A:
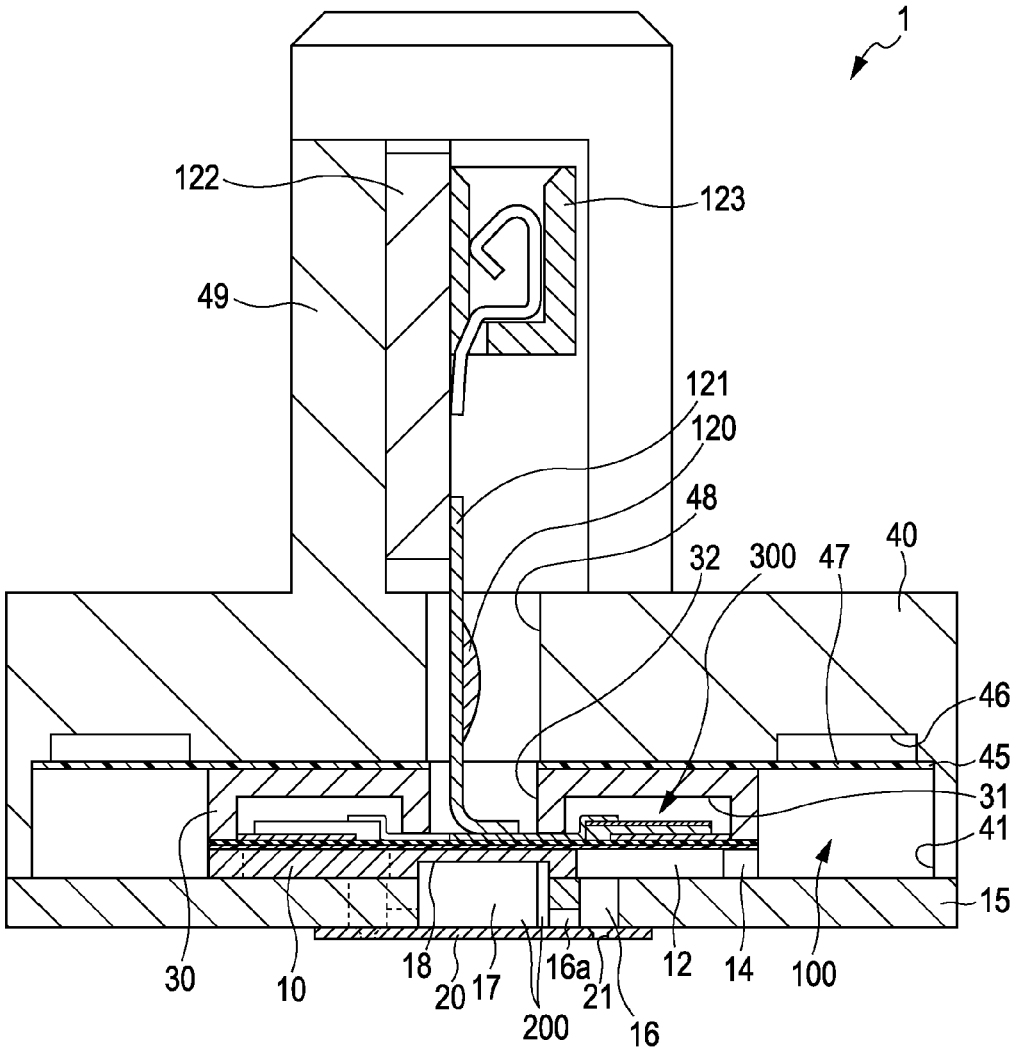
FIG. 3A is a cross-sectional view illustrating the recording head of the first embodiment taken along the line IIIA-IIIA in FIG. 2.
Figure 3B:
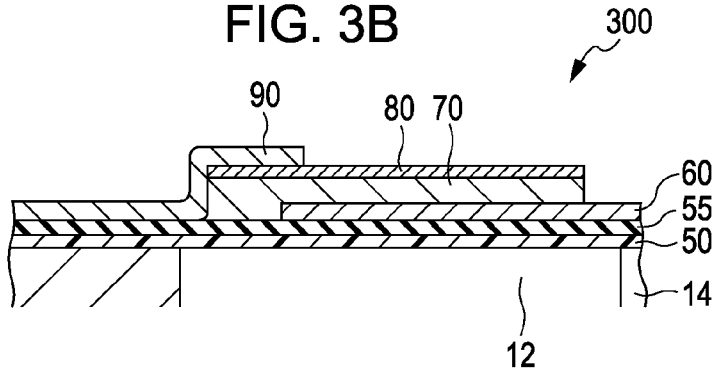
FIG. 3B is a cross-sectional view partially illustrating the ink jet recording head in FIG. 3A in an enlarged manner.
Figure 4:
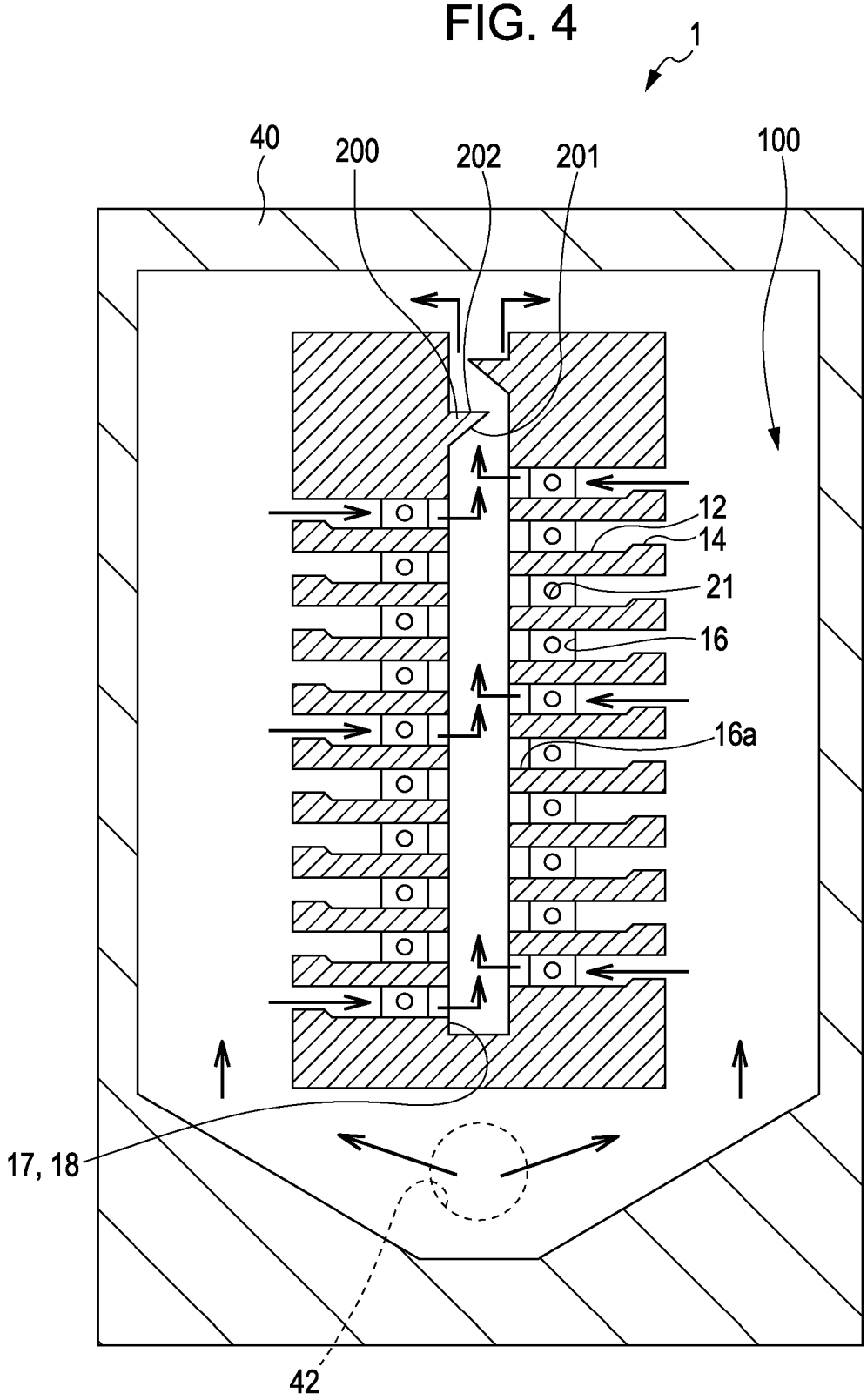
FIG. 4 is a cross-sectional view illustrating the channel configuration of the recording head of the first embodiment.

FIG. 1 is an exploded perspective view illustrating an ink jet recording head as an example of a liquid-ejecting head of the first embodiment of the invention. FIG. 2 is a cross-sectional view illustrating the ink jet recording head in the lateral direction of a pressure-generating chamber. FIG. 3A is a cross-sectional view illustrating the ink jet recording head taken along the line IIIA-IIIA in FIG. 2, and FIG. 3B is a cross-sectional view partially illustrating the ink jet recording head in FIG. 3A in an enlarged manner. FIG. 4 is a cross-sectional view illustrating a channel configuration. In this embodiment, a silicon single-crystal substrate having a (110) orientation is used to form a channel-forming substrate 10, and an elastic film 50 that is made by using silicon dioxide is provided on one surface of the channel-forming substrate 10 as illustrated in the drawings. The channel-forming substrate 10 has two lines individually including a plurality of pressure-generating chambers 12 which are aligned in parallel in the width direction of the channel-forming substrate 10. In the two lines of the pressure-generating chambers 12 which are aligned in parallel in the width direction, the pressure-generating chambers 12 of one line are provided so as not to face the pressure-generating chambers 12 of the other line. Viewed from the pressure-generating chambers 12 of one line, the pressure-generating chambers 12 of the other line are displaced in half a distance to the adjacent pressure-generating chamber 12 in the width direction. By virtue of such a configuration, nozzle openings 21 which will be hereinafter described in detail are displaced in half a distance to the adjacent nozzle opening in a similar manner in the individual two lines of the nozzle openings 21, thereby doubling resolution.

An ink-supplying channel 14 is provided at one end of each of the pressure-generating chambers 12 of the channel-forming substrate 10 in the longitudinal direction. Ink is supplied from a manifold 100 to the pressure-generating chambers 12 through the ink-supplying channels 14, the manifold 100 serving as a common liquid chamber for each of the pressure-generating chambers 12. Each of the ink-supplying channels 14 has a width narrower than that of each of the pressure-generating chambers 12, thereby uniformly maintaining channel resistance of the ink which flows from the manifold 100 to the pressure-generating chambers 12. Meanwhile, in this embodiment, the pressure-generating chambers 12 and ink-supplying channels 14 function as individual channels which are in communication with the manifold 100 as the common liquid chamber.

A communication plate 15 is provided to an opening surface (surface on the side opposite to the elastic film 50) of the channel-forming substrate 10 with an adhesive or thermally-fused film interposed therebetween. The communication plate 15 has communication channels 16 which are formed so as to penetrate the communication plate 15 in the thickness direction and which are in communication with the corresponding pressure-generating chambers 12. The communication channels 16 are provided so as to be in communication with one ends of the corresponding pressure-generating chambers 12 in the longitudinal direction, such one ends being positioned opposite to the ends that are in communication with the ink-supplying channel 14. The communication channels 16 are independently provided for the corresponding pressure-generating chambers 12. The communication channels 16 are therefore approximately linearly aligned as in the case of the lines of the pressure-generating chambers 12. The pressure-generating chambers 12 are in communication with the nozzle openings 21 (hereinafter described in detail) through the communication channels 16.

In addition, the communication plate 15 has a circulation channel 17. The circulation channel 17 is provided between one line of the pressure-generating chambers 12 and the other adjacent line of the pressure-generating chambers 12 approximately linearly aligned in parallel and is positioned in parallel with the entire two lines. The circulation channel 17 is in communication with the individual communication channels 16 of the communication plate 15 through circulation communication channels 16*a* which are provided for the corresponding communication channels 16 and which each have a hollow structure that opens toward a nozzle plate 20. In this embodiment, the lines of the pressure-generating chambers 12 aligned in parallel are in communication with the circulation channel 17 in common through the corresponding communication channels 16.

The circulation channel 17 is formed so as to penetrate the communication plate 15 in the thickness direction. In this embodiment, the channel-forming substrate 10 has an expansion portion 18 formed so as to partially face the circulation channel 17 and having a hollow structure. The expansion portion 18 has a hollow structure and has opening width and length approximately the same as those of the circulation channel 17, thereby increasing the cross-sectional area (cross-sectional area in the radial direction of the channel) of the circulation channel 17. In other words, the circulation channel 17 of the communication plate 15 and the expansion portion 18 of the channel-forming substrate 10 actually form a circulation channel of this embodiment.

Narrow portions 200 are provided to part of the circulation channel 17. The narrow portions 200 function to gradually decrease the cross-sectional area of the circulation channel 17 (cross-sectional area in the radial direction of the channel across the ink flow) and gradually increase the decreased area to the initial size. The narrow portions 200 will be hereinafter described in detail.

In the circulation channel 17, the side not facing the expansion portion 18 (side facing the nozzle plate 20) is sealed by the nozzle plate 20.

The communication plate 15 has an area larger than that of the channel-forming substrate 10 (surface to which the channel-forming substrate 10 is bonded) and defines the manifold 100 together with a case 40 in a region outside the ink-supplying channels 14 defined by the channel-forming substrate 10, the case 40 being hereinafter described in detail. The communication plate 15 therefore has an area approximately the same as that of the case 40 in the plan view in the direction of droplet ejection.

The nozzle plate 20 is attached to the surface, which is opposite to the channel-forming substrate 10, of the communication plate 15 with an adhesive or thermally-fused film interposed therebetween. The nozzle plate 20 has the nozzle openings 21 which are in communication with the corresponding pressure-generating chambers 12 through the individual communication channels 16. Examples of a material used for the nozzle plate 20 include metal such as stainless steel, a glass ceramic material, and a silicon single-crystal substrate.

In this embodiment, the nozzle plate 20 has a size smaller than that of the communication plate 15. The nozzle plate 20 at least has a size adequate to entirely cover the two lines of the openings of the communication channels 16, the openings facing the nozzle plate 20. In addition, the nozzle plate 20 has a size which enables the circulation channel 17 to be sealed. In particular, the nozzle plate 20 does not entirely cover one surface of the communication plate 15 but has a size adequate to cover the circulation channel 17 and communication channels 16 of the communication plate 15. The nozzle plate 20 is formed so as to have a size smaller than that of the communication plate 15 in the plan view in the ejection direction in this manner, thereby being able to reduce production costs. Meanwhile, although not illustrated, a water-repellent film having water-repellent properties (liquid-repellent properties) is provided to the liquid-ejecting surface (side opposite to the communication plate 15) of the nozzle plate 20. The water-repellent film is expensive, and the production costs of the nozzle plate 20 are therefore increased depending on the area of the water-repellent film to be formed. In this embodiment, the nozzle plate 20 is formed so as to have a small size with the result that the area of the water-repellent film to be formed is reduced, thereby being able to decrease the production costs of the nozzle plate 20. It is obvious that the area of a metallic plate or ceramic plate as a material used for the nozzle plate 20 can be simply decreased, thereby being able to reduce the production costs.

The elastic film 50 is provided onto the surface, which is opposite to the communication plate 15, of the channel-forming substrate 10 as described above. An insulating film 55 is formed on the elastic film 50 by using, for example, zirconium oxide. Piezoelectric actuators 300 is each formed as a result of stacking a first electrode 60, piezoelectric layer 70, and a second electrode 80 on the insulating film 55 in sequence through deposition or by a lithographic technique. In this case, the piezoelectric actuator 300 refers to a section including the first electrode 60, piezoelectric layer 70, and second electrode 80. In general, any one of the electrodes of each of the piezoelectric actuators 300 functions as a common electrode, and the other electrode and the piezoelectric layer 70 are patterned for each of the pressure-generating chambers 12. In this embodiment, the first electrode 60 serves as the common electrode of the piezoelectric actuators 300, and the second electrode 80 serves as the individual electrodes of the piezoelectric actuators 300. The first electrode 60 and the second electrode 80 may be, however, configured so as to have opposite functions each other depending on the configuration of a driving circuit and wiring. Although the elastic film 50, insulating film 55, and first electrode 60 form a vibrating plate in this embodiment, embodiments of the invention are not obviously limited to such a configuration. The elastic film 50 and insulating film 55 may not be, for example, formed, and the first electrode 60 may alone serve as the vibrating plate. Furthermore, the piezoelectric actuators 300 themselves may also substantially function as the vibrating plate.

The second electrodes 80 as the individual electrodes of the piezoelectric actuators 300 are individually connected to lead electrodes 90 which are formed by using, for example, gold (Au). A circuit board 121 as a flexible wiring board which is formed in the manner of chip on film (COF) contacts the lead electrodes 90, and a driving circuit 120 such as a driving integrated circuit (IC) is provided to the circuit board 121. Signals are transmitted from the driving circuit 120 to the individual piezoelectric actuators 300 through the circuit board 121 and lead electrodes 90.

A protection substrate 30 is attached so as to overlie the piezoelectric actuators 300-side surface of the channel-forming substrate 10 by using an adhesive or thermally-fused film in a region which faces the piezoelectric actuators 300, and the protection substrate 30 has holding portions 31 which can serve to secure spaces sufficient to ensure deformation of the piezoelectric actuators 300. The piezoelectric actuators 300 are formed in the holding portions 31 and are therefore protected so as to be substantially free from influence of external environment. In this embodiment, the two lines of the piezoelectric actuators 300 aligned in parallel in the width direction are formed so as to correspond to the two lines of the pressure-generating chambers 12 aligned in parallel in the width direction, and the holding portions 31 are provided so as to cover the entire lines of the piezoelectric actuators 300 aligned in parallel in the width direction. In addition, the holding portions 31 are independently provided for the individual lines of the piezoelectric actuators 300.

The protection substrate 30 has a through-hole 32 which is formed between the two holding portions 31 so as to penetrate the protection substrate 30 in the thickness direction. One ends of the lead electrodes 90 extending from the piezoelectric actuators 300 above the channel-forming substrate 10 are extended so as to be exposed inside the through-hole 32. The lead electrodes 90 are electrically connected to the circuit board 121 inside the through-hole 32.

In this embodiment, the protection substrate 30 is formed so as to have a size (area of the bonded surface) substantially the same as that of the channel-forming substrate 10. Examples of a material used for the protection substrate 30 include glass, a ceramic material, metal, and resin. The protection substrate 30 is preferably formed by using a material having a coefficient of thermal expansion substantially the same as that in the channel-forming substrate 10, and the silicon single-crystal substrate used as a material of the channel-forming substrate 10 is also used to form the protection substrate 30 in this embodiment.

The case 40 is attached to the side, which is opposite to the channel-forming substrate 10, of the protection substrate 30, and the case 40 forms the manifold 100.

The case 40 has a hollow 41 which faces the protection substrate 30, and the channel-forming substrate 10 and the protection substrate 30 are accommodated in the hollow 41. The hollow 41 has an area larger than the area in which the protection substrate 30 is attached to the channel-forming substrate 10 and has a depth approximately the same as the total thickness of the channel-forming substrate 10 and protection substrate 30 which have been attached to each other. The opening of the hollow 41 is sealed by the communication plate 15, thereby holding the protection substrate 30 and the channel-forming substrate 10 inside the hollow 41. In particular, the surface, which is opposite to the channel-forming substrate 10, of the protection substrate 30 is attached to the inside of the hollow 41, and the surface, to which the channel-forming substrate 10 has been attached, of the communication plate 15 is attached to the surface, which has the opening of the hollow 41, of the case 40 (surface around the hollow 41). By virtue of such a configuration, the channel-forming substrate 10 and the protection substrate 30 are held inside the hollow 41, and the manifold 100 is formed in a region (edge) outside the ink-supplying channels 14 defined by the channel-forming substrate 10 and protection substrate 30, the manifold 100 being provided as a space defined by the case 40 and communication plate 15. In this embodiment, the protection substrate 30 and channel-forming substrate 10 are held at the center of the hollow 41 of the case 40, and the manifold 100 is formed at the two sides of the center of the hollow 41 so as to be in communication with each of the pressure-generating chambers 12. With reference to FIG. 4, the manifold 100 is provided so as to continuously surround the peripheries of the channel-forming substrate 10 and protection substrate 30. The manifold 100 has a branched channel in which ink that is fed from an introduction channel 42 formed in the case 40 is distributed to the individual lines of the pressure-generating chambers 12. A side wall of the manifold 100 is defined by the edges of the channel-forming substrate 10 and protection substrate 30. One end of the circulation channel 17 is not in communication with the manifold 100. The circulation channel 17 is in communication with the pressure-generating chambers 12 through the corresponding communication channels 16 and circulation communication channels 16*a*. The other end of the circulation channel 17 is in communication with the manifold 100 in the direction in which the pressure-generating chambers 12 are aligned in parallel.

The case 40 has the introduction channel 42 which is in communication with the manifold 100 to supply ink to the manifold 100.

The introduction channel 42 is formed so as to be in communication with the middle of the upper portion (side opposite to the communication plate 15) of the manifold 100, such an upper portion being positioned to one side of each of the channel-forming substrate 10 and protection substrate 30 in the lateral direction of the pressure-generating chambers 12.

The introduction tube 42 is connected to one end of a supplying tube which is provided in the form of a tube, the supplying tube having the other end that is connected to an external liquid-storing unit (not illustrated) in which ink is stored. The introduction channel 42 may be obviously directly connected to a liquid-storing unit such as an ink cartridge.

The sealing film 45 is provided to the bottom of the hollow 41 of the case 40, the bottom being positioned on the side to which the protection plate 30 is attached. The sealing film 45 is formed by using a flexible material having low rigidity, such as polyphenylene sulfide (PPS). The manifold 100 is partially sealed by the sealing film 45.

The case 40 has regions facing the manifold 100 and having hollow structures, and such regions serve as space 46. In the manifold 100, the side near the case 40 (side opposite to the communication plate 15) partially functions as flexible portions 47 which are sealed by the sealing film 45 alone and which can be flexibly deformed.

The case 40 has a connection hole 48 which is formed so as to penetrate the case 40 in the thickness direction and so as to be in communication with the through-hole 32 of the protection substrate 30. The circuit board 121 inserted into the connection hole 48 is also inserted into the through-hole 32 of the protection substrate 30, thereby contacting the lead electrodes 90. A wall 49 is provided on the surface, which is opposite to the opening of the hollow 41, of the case 40 at the periphery of the opening of the connection hole 48. The wall 49 supports the circuit board 121 and a connection substrate 122 attached to the circuit board 121. In this embodiment, the connection substrate 122 is configured as a rigid substrate to which a connector 123 is provided, and the connector 123 is connected to external wiring. The circuit board 121 connected to the lead electrodes 90 is electrically connected to the connection substrate 122. External wiring (not illustrated) is connected to the connector 123 of the connection substrate 122, thereby transmitting printing signals from the external wiring to the circuit board 121.

The case 40 having such a configuration is used to form the manifold 100, thereby being able to reduce the size of each of the channel-forming substrate 10 and protection substrate 30. In the case where a manifold is formed in a channel-forming substrate or protection substrate, for example, the channel-forming substrate or protection substrate defines the peripheral wall of the manifold, and the sizes of the channel-forming substrate and protection substrate are therefore increased in the longitudinal direction of a pressure-generating chamber. To the contrary, in this embodiment, the edges of the channel-forming substrate 10 and protection substrate 30 define one side of the manifold 100 (in the longitudinal direction of the pressure-generating chamber 12), and the caser 40 defines the other side of the manifold 100. The size of each of the channel-forming substrate 10 and protection substrate 30 can be therefore reduced. Owing to such an advantage, in the case where a plurality of the channel-forming substrates 10 or protection substrates 30 are integrally produced from a large substrate such as a silicon wafer, the size reduction of the channel-forming substrate 10 and protection substrate 30 enables the number of products produced from the large substrate to be increased, thereby being able to reduce production costs. Meanwhile, a plurality of the channel-forming substrates 10 or protection substrates 30 are integrally produced from a large substrate such as a silicon wafer with the result that a plurality of the channel-forming substrates 10 or protection substrates 30 can be simultaneously formed, thereby being able to reduce production costs.

In this embodiment, the communication plate 15 defines the nozzle plate 20-side surface of the manifold 100, and the nozzle plate 20 does not therefore need to have a size adequate to overlap the manifold 100 in the stacking direction (thickness direction). The nozzle plate 20 can be accordingly formed so as to have a reduced size, thereby being able to reduce the production costs of the nozzle plate 20.

Figure 5:
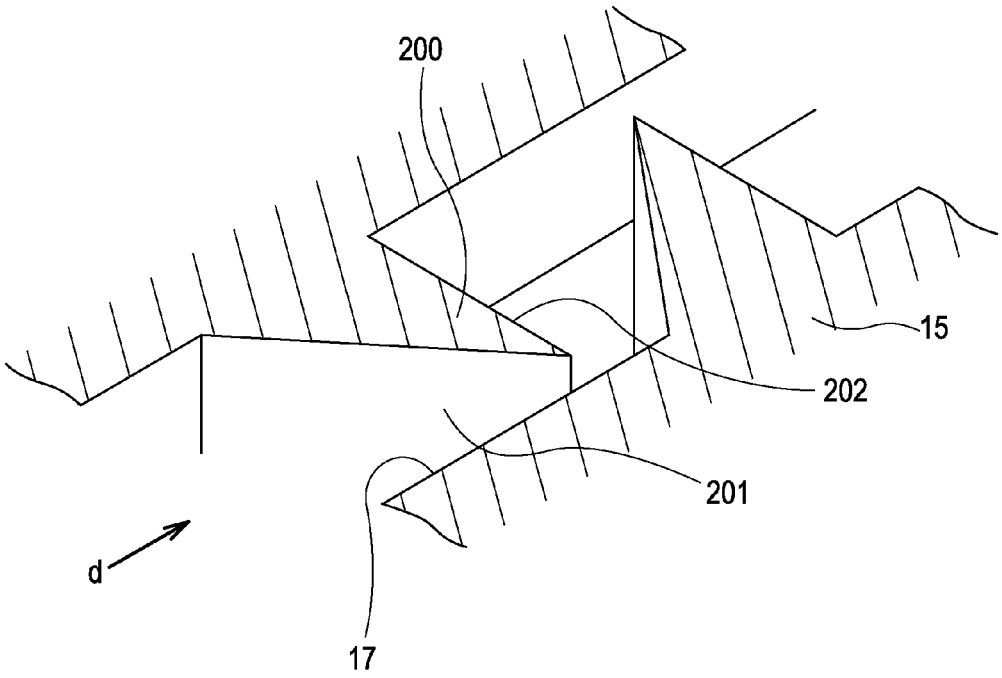
FIG. 5 is a perspective view partially illustrating the channel of the recording head of the first embodiment in an enlarged manner.
Figure 6:
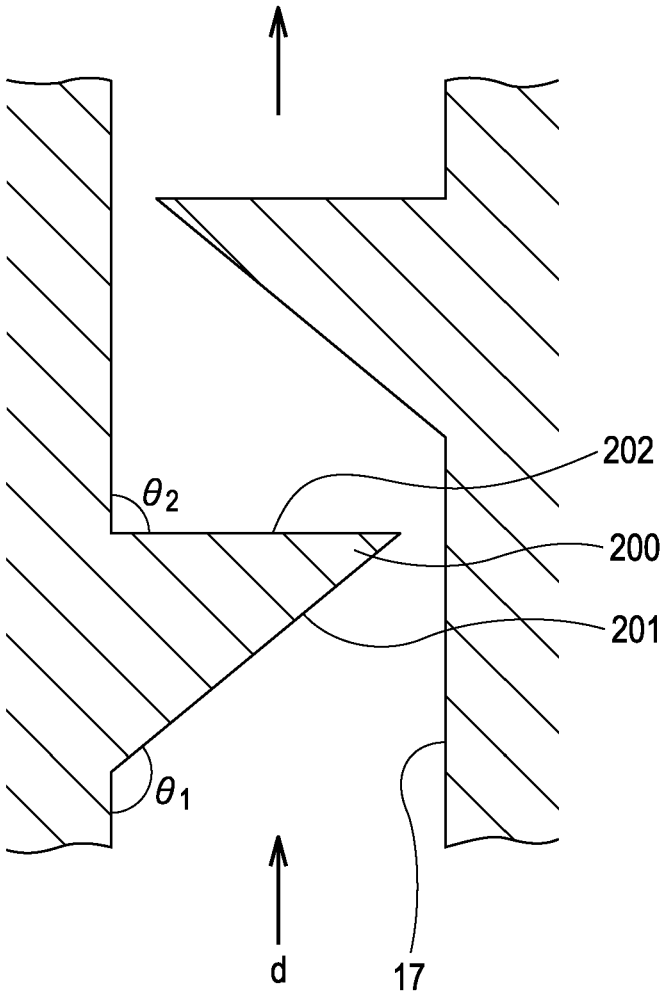
FIG. 6 is a plan view partially illustrating the channel of the first embodiment in an enlarged manner.

The narrow portions 200 formed in the circulation channel 17 are described in detail with reference to FIGS. 4 to 6. FIG. 5 is a perspective view partially illustrating the channel in an enlarged manner, and FIG. 6 is a plan view partially illustrating the channel in an enlarged manner.

As illustrated in the drawings, a plurality of the narrow portions 200 are provided on the downstream side (side opposite to the introduction channel 42) relative to a region in which the circulation channel 17 is in communication with the individual circulation communication channels 16*a*, and two narrow portions 200 are provided in this embodiment.

The narrow portions 200 are provided so as to protrude from the inner walls of the circulation channel 17 in the radial direction of the channel. In other words, the narrow portions 200 protrude so as to intersect a direction (hereinafter referred to as a forward direction d) in which the ink flows in the circulation channel 17 to circulate from the pressure-generating chambers 12 to the manifold 100 (side opposite to the introduction channel 42) and are provided so as to reduce the cross-sectional area of the circulation channel 17 in the radial direction of the channel. In this case, the cross-sectional area of the circulation channel 17 hereinafter refers to a cross-sectional area in the radial direction of the channel and a cross-sectional area which intersects the forward direction d.

Each of the narrow portions 200 has a first wall 201 and second wall 202 which are each tilted with respect to the forward direction d. The first wall 201 serves to gradually decrease the cross-sectional area of the circulation channel 17 toward the downstream side (side opposite to the introduction channel 42). The second wall 202 serves to gradually increase the cross-sectional area, which has been gradually decreased by the first wall 201, of the circulation channel 17 with the result that the circulation channel 17 comes to have the cross sectional-area of the same size as that in the upstream side relative to the first wall 201.

In particular, each of the narrow portions 200 has the first wall 201 which faces the upstream side in the forward direction d and has the second wall 202 which faces the downstream side in the forward direction d.

In each of the narrow portions 200, the first wall 201 and second wall 202 each have a flat surface profile, and the tip of the first wall 201 contacts the tip of the second wall 202. In particular, viewed from the top of the channel-forming substrate 10, each of the narrow portions 200 has a triangular shape. In each of the narrow portions 200, the first wall 201 has a tilt angle $\theta_1$ with respect to the inner wall of the circulation channel 17 at the upstream side relative to the first wall 201 in the forward direction d, and the tilt angle $\theta_1$ is larger than the tilt angle $\theta_2$ of the second wall 202 with respect to the inner wall of the circulation channel 17 at the downstream side relative to the second wall 202 in the forward direction d ($\theta_1 > \theta_2$).

In particular, in each of the narrow portions 200, a proportion (decreasing rate: tilt angle) in which the first wall 201 functions to decrease the cross-sectional area of the circulation channel 17 in an unit distance in the forward direction d is smaller than a proportion (decreasing rate: tilt angle) in which the second wall 202 functions to decrease the cross-sectional area of the circulation channel 17 in an unit distance in a direction opposite to the forward direction d.

The narrow portions 200 each having the first wall 201 and second wall 202 are provided in this manner, thereby being able to decrease the channel resistance of the ink flowing in the circulation channel 17 in the forward direction d relative to the channel resistance in the opposite direction. In particular, in the case where each of the narrow portions 200 serves to decrease the width (width in the longitudinal direction of the pressure-generating chamber 12) of the circulation channel 17 to a dimension of 5.0 μm, a ratio of the channel resistance in the forward direction d to the channel resistance in the opposite direction is 0.84%. Furthermore, in the case where each of the narrow portions 200 serves to decrease the width of the circulation channel 17 to a dimension of 10 μm, such a ratio in the channel resistance is 0.65%.

In the ink jet recording head 1 having such a configuration, in the case where the ink in the pressure-generating chambers 12 is respectively exposed to generation of positive pressure and negative pressure as a result of increasing and decreasing the volume of the pressure-generating chambers 12 by the driving of the piezoelectric actuators 300, the ink reciprocates in the circulation channel 17 in the forward direction d and opposite direction, respectively. In this case, because formation of the narrow portions 200 contributes to generating difference between the forward direction d and opposite direction in the channel resistance of ink which flows in the circulation channel 17, the ink easily flows in the forward direction d and has difficulty in flowing in the opposite direction. The ink in the pressure-generating chambers 12 can be therefore transported through the circulation channel 17 in the forward direction d as a result of the driving of the piezoelectric actuators 300.

Meanwhile, in such driving of the piezoelectric actuators 300, for example, the piezoelectric actuators 300 may not be driven to eject ink droplets, but a voltage may be applied in a degree in which ink droplets are not ejected from the nozzle openings 21. In other words, the piezoelectric actuators 300 may be driven so as to slightly vibrate.

The ink in the circulation channel 17 can be transported in one direction only as a result of driving the piezoelectric actuators 300 in this manner, the ink can be circulated without use of an additional pump or the like. The size of the ink jet recording head 1 and production costs can be accordingly decreased. In addition, ink can be successfully circulated, thereby being able to suppress the increase of ink viscosity due to drying of the ink and suppress precipitation of components contained in the ink.

Figure 7:
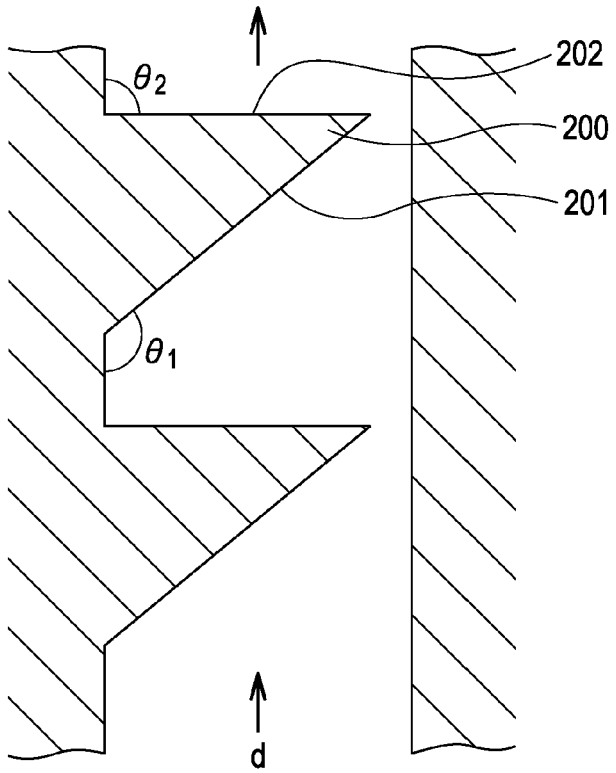
FIG. 7 is a cross-sectional view illustrating a modification of the channel of the first embodiment.
Figure 8:
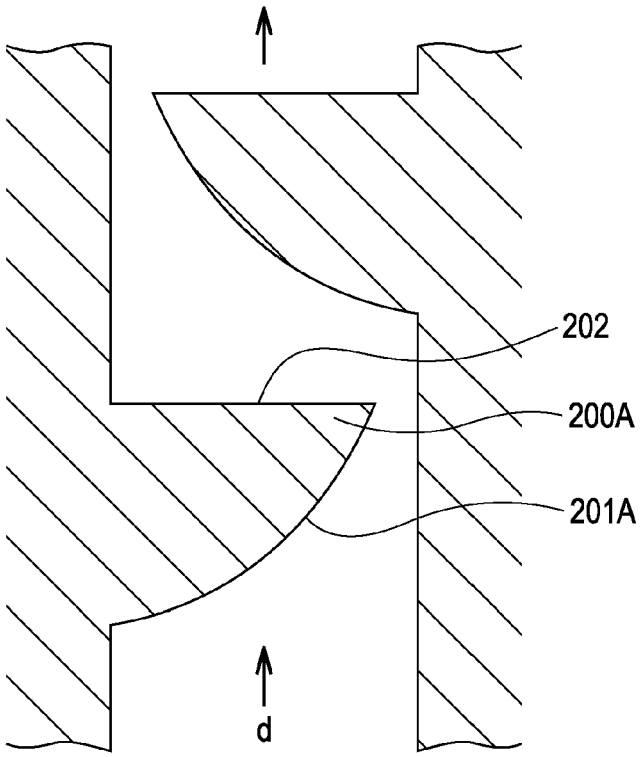
FIG. 8 is a plan view partially illustrating another modification of the channel of the first embodiment in an enlarged manner.

In the above embodiments, although the two narrow portions 200 are individually provided on the facing walls of the circulation channel 17, embodiments of the invention are not particularly limited to such a configuration. As illustrated in FIG. 7, for example, the two narrow portions 200 may be provided so as to protrude from one wall of the circulation channel 17 in the same direction. In addition, because the first wall 201 and second wall 202 of each of the narrow portions 200 may function to gradually decrease or increase the cross-sectional area of the circulation channel 17 in the forward direction d, the first wall 201 and second wall 202 may have any surface profile other than a planar surface. In particular, for example, a narrow portions 200A may be configured so as to each have a first wall 201A having a curved surface (circular arc-shaped cross-sectional surface), not a planar surface, as illustrated in FIG. 8.

The number and configurations of the narrow portions 200 and 200A are not obviously limited to the above. The narrow portions 200 and 200A may be, for example, provided in the number of one or at least three, and the narrow portions 200 and 200A may be provided to the circulation communication channels 16*a*.

In the ink jet recording head 1 having the above configuration, ink is fed from the liquid-storing unit 5 through the introduction channel 42, and the inside of the ink jet recording head 1 is then filled with the ink from the manifold 100 to the nozzle openings 21. On the basis of signals transmitted from the driving circuit 120, a voltage is applied between the first electrode 60 and the second electrodes 80 corresponding to the individual pressure-generating chambers 12, and the elastic film 50, insulating film 55, first electrode 60, and piezoelectric layer 70 are bended and deformed, thereby increasing pressure inside the corresponding pressure-generating chambers 12 with the result that ink droplets are ejected from the nozzle openings 21.

As described above, the ink supplied to the pressure-generating chambers 12 can be retrieved (namely, circulated) to the manifold 100 through the communication channels 16 and circulation channel 17 as a result of the driving of the piezoelectric actuators 300. In this case, the communication channels 16 are provided to form communications between the pressure-generating chambers 12 and the nozzle openings 12, and communications are formed between each of the communication channels 16 and the circulation channel 17, thereby being able to retrieve the ink, which has been supplied in the vicinity of the nozzle openings 21 immediately before being ejected, to the manifold 100. Ink viscosity is accordingly prevented from being increased resulting from drying of ink immediately before being ejected, and precipitation of components contained in the ink can be also suppressed. Even after passage of a certain time period, ejection characteristics of ink can be maintained to a substantially uniform level. The ejection characteristics can be therefore prevented from varying, and the quality of liquid ejection can be enhanced.

Second Embodiment

Figure 9A:
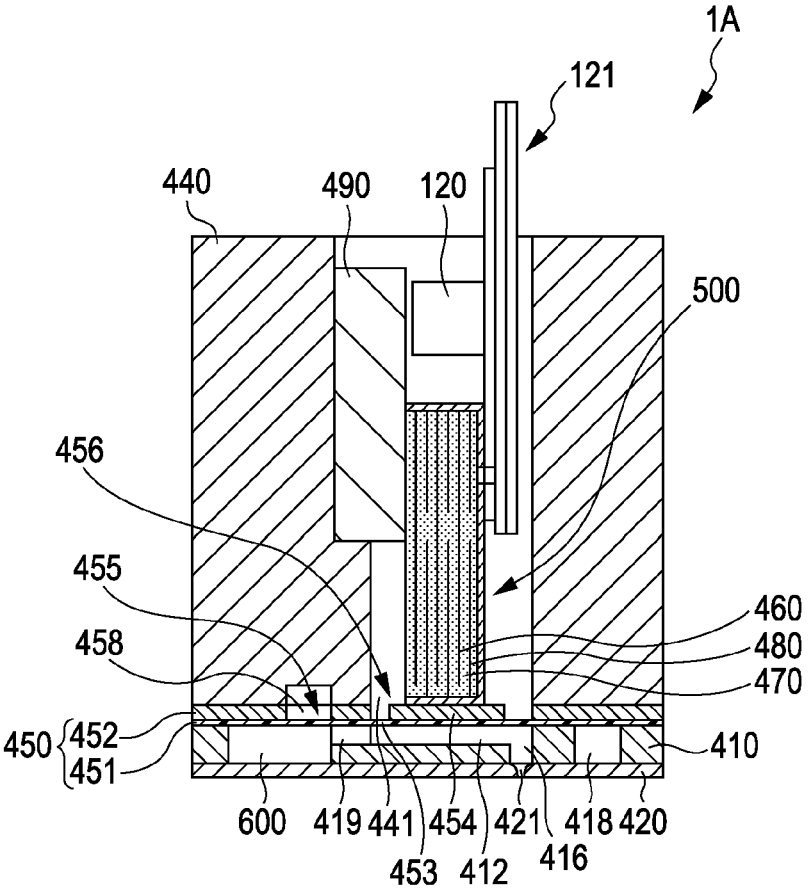
FIG. 9A is a cross-sectional view illustrating a recording head of a second embodiment.
Figure 9B:
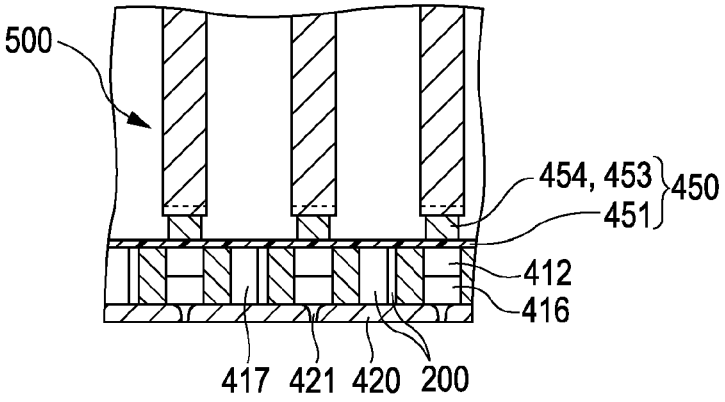
FIG. 9B is a cross-sectional view illustrating the recording head of the second embodiment.
Figure 10:
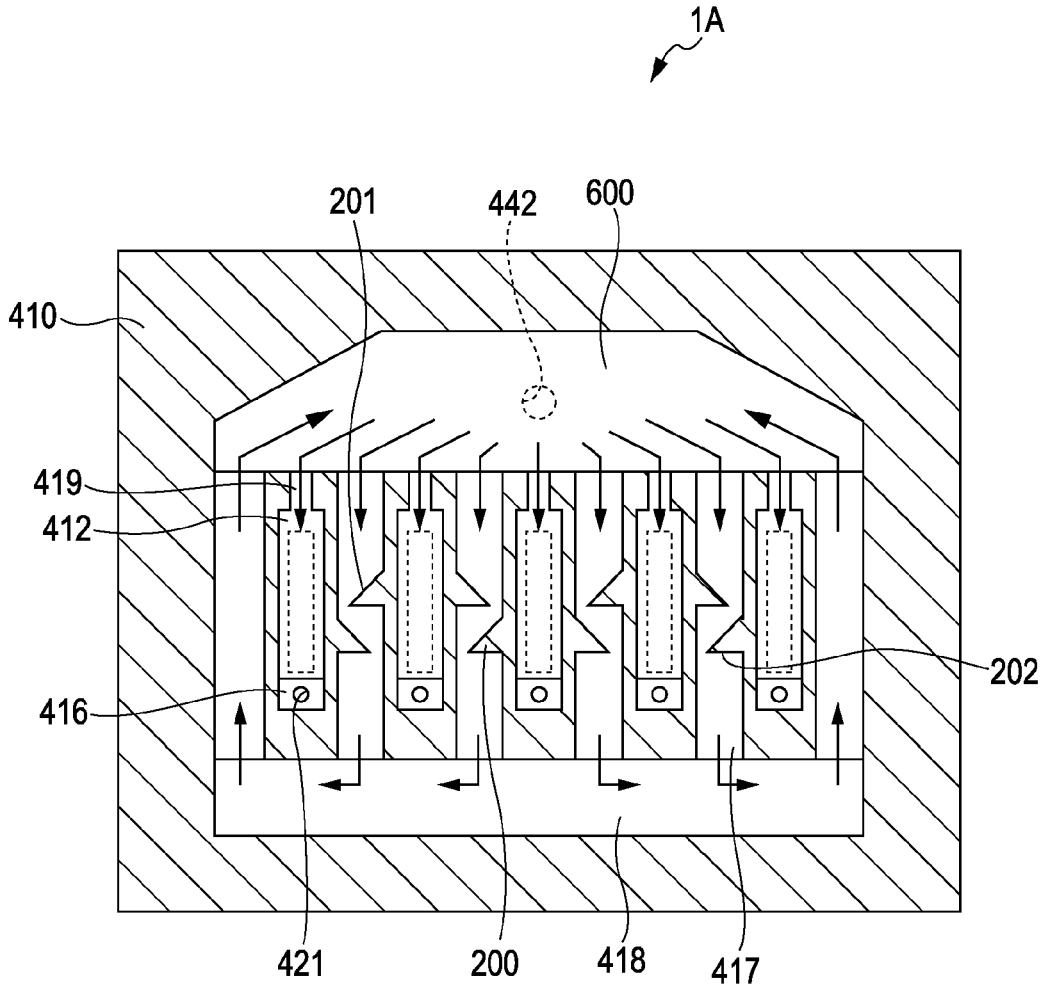
FIG. 10 illustrates the channel configuration of the recording head of the second embodiment.

FIGS. 9A and 9B are each a cross-sectional view illustrating an ink jet recording head as an example of a liquid-ejecting head of a second embodiment of the invention. FIG. 10 is a plan view illustrating a channel-forming substrate.

With reference to FIG. 9A, an ink jet recording head 1A of this embodiment includes a channel-forming substrate 410 in which a plurality of pressure-generating chambers 412 are formed in parallel; a nozzle plate 420 in which nozzle openings 421 are formed so as to be in communication with the corresponding pressure-generating chambers 412; a vibrating plate 450 which is formed on a surface of the channel-forming substrate 410, such a surface being opposite to the nozzle plate 420; and a piezoelectric actuators 500 which are formed so as to overlie the vibrating plate 450.

With reference to FIGS. 9A to 10, the pressure-generating chambers 412 are formed such that the channel-forming substrate 410 is segmented by partitions and are aligned in parallel in the width direction of the channel-forming substrate 410. In the channel-forming substrate 410, a manifold 600 is formed in a region on the side of one ends of the pressure-generating chambers 412 in the longitudinal direction of the pressure-generating chambers 412 so as to penetrate the pressure-forming substrate 410. The manifold 600 is in communication with the pressure-generating chambers 412 through corresponding ink-supplying channels 419. In this embodiment, each of the ink-supplying channels 419 is formed so as to have a width smaller than that of each of the pressure-generating chambers 412 and serves to uniformly maintain the channel resistance of ink which flows from the manifold 600 to each of the pressure-generating chambers 412.

In the channel-forming substrate 410, a circulation liquid chamber 418 is formed in a region on the side of the other ends of the pressure-generating chambers 412 in the longitudinal direction of the pressure-generating chambers 412. The circulation liquid chamber 418 is in communication with the manifold 600 through a plurality of circulation channels 417 which are formed in the channel-forming substrate 410. Each of the circulation channels 417 is formed between individual groups including at least one pressure-generating chamber 12. In this embodiment, the circulation channels 417 are provided to the outside of the two sides of each of the pressure-generating chambers 412. In particular, the circulation channels 417 are provided to the outside of the two sides of the line of the pressure-generating chambers 412 and are provided between the two adjacent pressure-generating chambers 412. In this embodiment, the individual pressure-generating chambers 412 independently function as the group described above. Meanwhile, the group of the pressure-generating chambers may include two pressure-generating chambers 412, and the circulation channel 417 is provided between the groups. In other words, the circulation channel 417 may be alternately formed between the two adjacent pressure-generating chambers. The group of the pressure-generating chambers may obviously include three or more pressure-generating chambers 412.

Each of the circulation channels 417 is formed between the manifold 600 and the circulation liquid chamber 418 so as to have a constant width. In this embodiment, for example, each of the circulation channels 417 is formed so as to have a width substantially the same as that of each of the pressure-generating chambers 412 and so as to penetrate the channel-forming substrate 410.

In this embodiment, the pressure-generating chambers 412 are formed so as not to penetrate the channel-forming substrate 410. Communication channels 416 are formed at the ends, which are opposite to the manifold 600, of the individual pressure-generating chambers 412 so as to penetrate the channel-forming substrate 410, the communication channels 416 being in communication with the corresponding nozzle openings 421.

A nozzle plate 420 is attached to one surface of the channel-forming substrate 410. The individual nozzle openings 421 are in communication with the corresponding pressure-generating chambers 412 through the corresponding communication channels 416 formed in the channel-forming substrate 410 as described above. The vibrating plate 450 is attached to the other surface, which is the opening side of the pressure-generating chambers 412, of the channel-forming substrate 410. The pressure-generating chambers 412, circulation channels 417, manifold 600, and circulation liquid chamber 418 are sealed by the vibrating plate 450. The piezoelectric actuators 500 abut on the vibrating plate 450 and are fixed thereto so as to correspond to the pressure-generating chambers 412. The piezoelectric actuators 500 each have a structure in which a piezoelectric layer 470 is disposed between individual internal electrodes 480 and a common internal electrode 460. An inactive region of each of the piezoelectric actuators 500 is adhesively attached to a fixing substrate 490, the inactive region not contributing to piezoelectric deformation. A circuit board 121 on which the driving circuit 120 is mounted is connected to the inactive region of each of the piezoelectric actuators 500.

A case 440 is fixed to the vibrating plate 450, and the case 440 has an accommodating portion 441 in which the piezoelectric actuators 500 fixed to the fixing substrate 490 are accommodated, the piezoelectric actuators 500 serving as the pressure generator which contributes to generating pressure change in the pressure-generating chambers 412. The case 440 has an introduction channel 442 (see FIG. 10) which is in communication with the manifold 600. The introduction channel 442 is connected to a liquid-storing unit through a supplying tube (not illustrated) which is provided in the form of a tube. Ink supplied from the liquid-storing unit to the manifold 600 flows to the circulation chamber 418 through the circulation channels 417, and the circulation chamber 418 is then filled with the ink. The ink in the circulation liquid chamber 418 is then retrieved to the manifold 600 through the circulation channels 417 which are positioned at the two sides of the line of the pressure-generating chambers 12 aligned in parallel in this embodiment. In other words, the circulation channels 417 and the circulation liquid chamber 418 form the circulation channel of this embodiment, and the two ends of such a circulation channel are in communication with the manifold 600.

Two narrow portions 200 each having the same structure as described in the first embodiment are provided in each of the circulation channels 417 provided between the pressure-generating chambers 412. Each of the narrow portions 200 is configured such that the first wall 201 faces the manifold 600 and such that the second wall 202 faces the circulation liquid chamber 418.

The vibrating plate 450 on which one ends of the piezoelectric actuators 500 abut is provided as a composite plate including an elastic film 451 and a supporting plate 452 which supports the elastic film 451, the elastic film 451 being made by using, for example, an elastic member such as a resin film, and the supporting plate 452 being made by using, for example, a metallic material. The elastic film 451 is attached to the channel-forming substrate 410. In the vibrating plate 450, islands 454 are formed in regions which face the corresponding pressure-generating chambers 412, and one ends of the piezoelectric actuators 500 abut on the corresponding islands 454. In particular, the vibrating plate 450 has thin portions 453 in regions which face the peripheries of the individual pressure-generating chambers 412, and the islands 454 are provided to the inside of the thin portions 453, the thin portions 453 each having a thickness thinner than those of the other portions.

The vibrating plate 450 has a flexible portion 455 in a region which faces the manifold 600, the flexible portion 455 being substantially configured by the elastic film 451 alone without the supporting plate 452 as in the case of thin portion 453. The case 440 has a space 456 in a portion facing the flexible portion 455, and the space 456 ensures deformation of the flexible portion 455.

In the ink jet recording head 1A having the above configuration, ink is supplied from the liquid-storing unit (not illustrated) to the introduction channel 442, and the ink supplied to the introduction channel 442 is then fed to the manifold 600. The ink fed to the manifold 600 is then supplied to the pressure-generating chambers 412 in part, and the piezoelectric actuators 500 are driven at the predetermined timing to change the volume of the corresponding pressure-generating chambers 412, thereby ejecting ink droplets from the nozzle openings 421. The pressure change which has been generated in the pressure-generating chambers 412 as a result of the driving of the piezoelectric actuators 500 acts on the ink in the manifold 600. The ink in the manifold 600 flows to the circulation channels 417 and the circulation liquid chamber 418 and is then retrieved (namely, circulated) to the manifold 600.

The ink jet recording head 1A of this embodiment also excludes use of an additional pump as in the case of the first embodiment described above, and ink can be circulated only as a result of the driving of the piezoelectric actuators 500. The size of the ink jet recording head can be therefore decreased, and production costs can be also reduced.

Other Embodiment

Although the individual embodiments of the invention have been described, the basic configuration of embodiments of the invention is not limited to the above embodiments. Although the silicon single-crystal substrate is, for example, used for the channel-forming substrates 10 and 410 in the above embodiments, any other materials may be used. Examples of such other materials include a silicon-on-insulator (SOI) substrate, glass material, and metallic material.

Although the thin-film piezoelectric actuator 300 and the longitudinal vibration-type piezoelectric actuator 500 are used as pressure generators in the above embodiments, embodiments of the invention are not limited to such structures, the pressure generator enabling pressure change to be generated in the pressure-generating chambers 12. Examples of the piezoelectric actuator to be used include a thick-film piezoelectric actuator which is formed, for example, as a result of attaching a green sheet. Other examples of the pressure generator to be used include one of a type in which a heater is disposed in a pressure-generating chamber and in which bubbles are generated as a result of heat emission by the heater with the result that droplets are ejected from nozzle openings and include an electrostatic actuator in which static electricity is generated between a vibrating plate and an electrode and in which the vibrating plate is then deformed by the electrostatic force with the result that droplets are ejected from nozzle openings.

Figure 11:
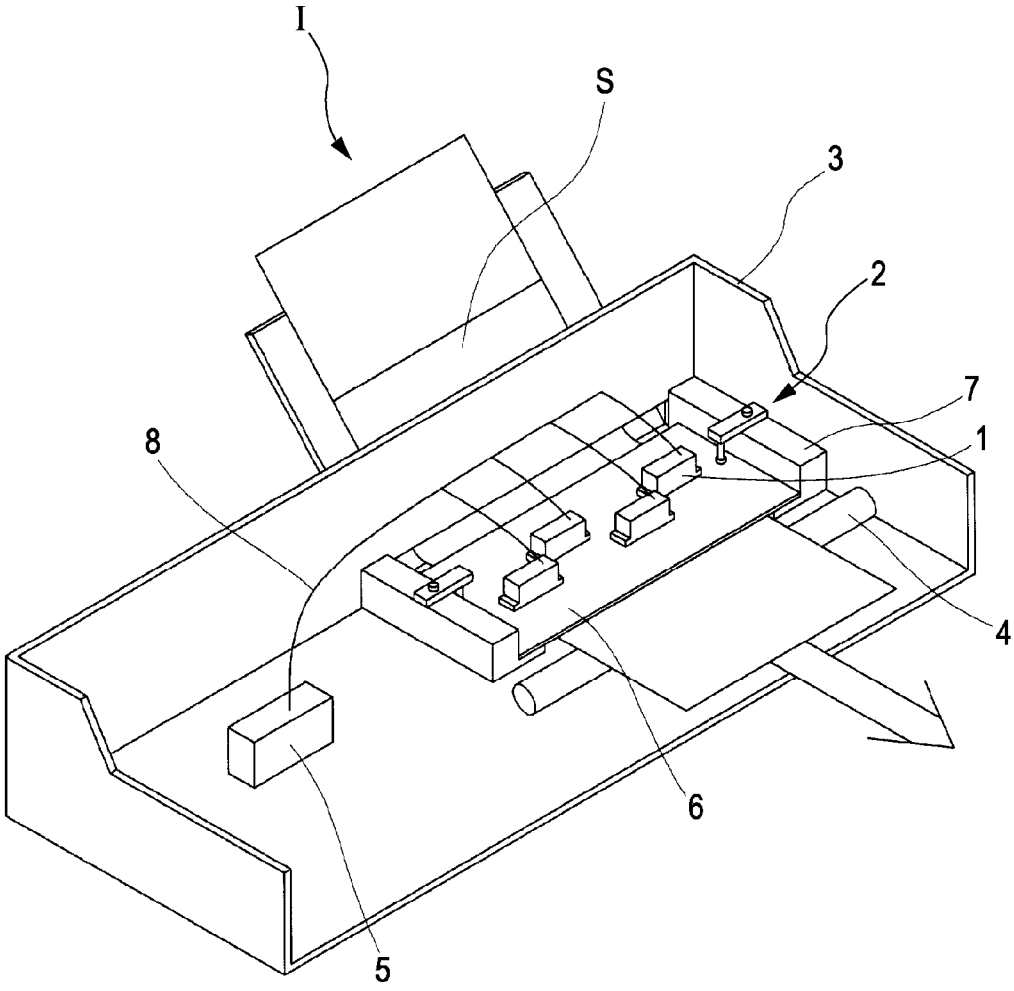
FIG. 11 schematically illustrates the configuration an embodiment of a recording apparatus.

The ink jet recording head 1 serves as a component of an ink jet recording head unit and is provided to an ink jet recording apparatus. FIG. 11 schematically illustrates an example of the ink jet recording apparatus.

The ink jet recording apparatus of this embodiment is configured as a line-type ink jet recording apparatus, in which the ink jet recording head 1 is fixed to the apparatus body and in which printing is performed as a result of transporting an ejection medium such as recording paper in a direction orthogonally intersecting a direction in which the nozzle openings 21 are aligned in parallel.

In particular, with reference to FIG. 11, an ink jet recording apparatus I has an ink jet recording head unit 2 including the ink jet recording head 1, an apparatus body 3, a roller 4 which transports a recording sheet S as a recording medium, and the liquid-storing unit 5.

The ink jet recording head unit 2 (hereinafter referred to as the head unit 2, where appropriate) has a plurality of the ink jet recording heads 1 and has a flat base plate 6 which holds the ink jet recording heads 1. The base plate 6 is attached to a frame 7, thereby fixing the head unit 2 to the apparatus body 3.

The roller 4 is provided to the apparatus body 3. The roller 4 transports the recording sheet S as the ejection medium such as paper which has been fed to the apparatus body 3 and helps the recording sheet S to pass below the ink-ejecting surfaces of the ink jet recording heads 1.

As described above, each of the ink jet recording heads 1 is connected to the liquid-storing unit 5 through the supplying tube 8 provided, for example, in the form of a flexible tube, the liquid-storing unit 5 being fixed to the apparatus body 3 to store the ink. Ink is supplied from the liquid-storing unit 5 to each of the ink jet recording heads 1 through the supplying tube 8.

In the ink jet recording apparatus I having such a configuration, the roller 4 transports the recording sheet S in the transport direction, and ink is ejected from the ink jet recording heads 1 of the head unit 2, thereby printing images on the recording sheet S.

In this embodiment, although the ink jet recording apparatus I includes a single head unit 2 having a plurality of the ink jet recording heads 1, the ink jet recording apparatus I may include two or more head units 2. Furthermore, the ink jet recording head 1 may be directly mounted on the ink jet recording apparatus I.

In the first and second embodiments, ink is circulated inside the ink jet recording heads 1 and 1A, respectively. Embodiments of the invention are not obviously limited to such configurations, and ink may be circulated outside the ink jet recording heads 1 and 1A. In particular, the liquid-storing unit 5 may be connected to a retrieving tube which serves to retrieve ink discharged from the circulation channels 17 and 417.

In this embodiment, although the line-type ink jet recording apparatus I in which the ink jet recording head 1 is fixed and in which recording is performed only as a result of transporting the recording sheet S is used, embodiments of the invention are not particularly limited to such a recording apparatus. Embodiments of the invention may be, for example, also applied to a serial-type ink jet recording apparatus in which the ink jet recording head 1 is mounted on a carriage which moves in a direction (main scanning direction) intersecting the transport direction of the recording sheet S and in which printing is performed while the ink jet recording head 1 moves in the main scanning direction.

In this embodiment, although the ink jet recording apparatus I has a configuration in which the liquid-storing unit 5 is fixed to the apparatus body 3, embodiments of the invention are not particularly limited to such a configuration. Embodiments of the invention may be, for example, also applied to an ink jet recording apparatus in which a liquid-storing unit such as an ink cartridge is fixed to each of the ink jet recording heads 1, the ink jet recording head unit 2, or a carriage.

In this embodiment, although the ink jet recording apparatus is used to describe an example of the liquid-ejecting apparatus, embodiments of the invention may be widely applied to any type of liquid-ejecting apparatus including a liquid-ejecting head. Embodiments of the invention may be obviously also applied to liquid-ejecting apparatuses including a liquid-ejecting head from which a liquid other than ink is ejected. Examples of such a liquid-ejecting head include various types of recording heads which are used for image-recording apparatuses such as a printer; color material-ejecting heads used for producing a color filter of a liquid crystal display or the like; electrode material-ejecting heads used for forming an electrode of an organic electroluminescent (EL) display, field emission display (FED), or the like; and bioorganic material-ejecting heads used for producing a biochip.

What is claimed is:

1. A liquid-ejecting head comprising:

a channel that is in communication with a nozzle opening that serves for liquid ejection, the channel including a pressure-generating chamber;

a circulation channel that serves to circulate a liquid in the channel; and a pressure generator that serves to generate pressure change in a liquid in the pressure-generating chamber, wherein the circulation channel has a narrow portion including a first wall and a second wall, the first wall tilting with respect to a forward direction in which a liquid flows and serving to gradually decrease the cross-sectional area of the circulation channel toward the downstream side in the forward direction, the second wall tilting with respect to the flow direction and serving to gradually increase the cross-sectional area that has been gradually decreased by the first wall, wherein the tilt angle of the first wall with respect to the inner surface of the circulation channel at the upstream side relative to the first wall is larger than the tilt angle of the second wall with respect to the inner surface of the circulation channel at the downstream side relative to the second wall.

2. The liquid-ejecting head according to claim 1, wherein a plurality of the narrow portions are provided.

3. The liquid-ejecting head according to claim 1, wherein, the first wall has a curved surface.

4. The liquid-ejecting head according to claim 1, wherein, the channel includes a common liquid chamber that is in communication with a plurality of the pressure-generating chambers in common, and the circulation channel has the two ends that are in communication with the common liquid chamber.

5. The liquid-ejecting head according to claim 1, wherein, the channel includes a common liquid chamber that is in communication with a plurality of the pressure-generating chambers in common, and the circulation channel has one end that is in communication with the common liquid chamber and has the other end that is in communication with each of the pressure-generating chambers.

6. A liquid-ejecting apparatus comprising the liquid-ejecting head according to claim 1.

7. A liquid-ejecting apparatus comprising the liquid-ejecting head according to claim 2.

8. A liquid-ejecting apparatus comprising the liquid-ejecting head according to claim 3.

9. A liquid-ejecting apparatus comprising the liquid-ejecting head according to claim 4.

10. A liquid-ejecting apparatus comprising the liquid-ejecting head according to claim 5.

* * * * *